US009464843B2

(12) United States Patent
Karafinka

(10) Patent No.: US 9,464,843 B2
(45) Date of Patent: Oct. 11, 2016

(54) SHOE DRYER

(76) Inventor: Alexander Karafinka, Yokneam (IL)

( * ) Notice: Subject to any disclaimer, the term of this patent is extended or adjusted under 35 U.S.C. 154(b) by 243 days.

(21) Appl. No.: 12/797,820

(22) Filed: Jun. 10, 2010

(65) Prior Publication Data

US 2011/0000098 A1 Jan. 6, 2011

(30) Foreign Application Priority Data

Jul. 6, 2009 (IL) ..... 199710

(51) Int. Cl.
*F26B 25/06* (2006.01)
*F26B 9/00* (2006.01)
*A47L 23/20* (2006.01)

(52) U.S. Cl.
CPC ..... *F26B 9/003* (2013.01); *A47L 23/205* (2013.01)

(58) Field of Classification Search
CPC ..... F26B 19/00; F26B 21/00; F26B 25/00; F26B 25/06
USPC ..... 34/202, 218, 239; 219/400, 386; 422/5
See application file for complete search history.

(56) References Cited

U.S. PATENT DOCUMENTS 2,465,362 A * 3/1949 Elliott ..... 34/104
3,299,529 A * 1/1967 Roberts et al. ..... 34/104
5,016,364 A 5/1991 Cochrane
5,165,181 A * 11/1992 Acosta et al. ..... 34/90
5,528,840 A * 6/1996 Pajak et al. ..... 34/622
5,592,750 A * 1/1997 Eichten ..... 34/104
5,666,743 A * 9/1997 Dawson ..... 34/219
5,987,773 A 11/1999 Lipscy
6,263,591 B1 * 7/2001 La Porte ..... 34/622
6,793,881 B2 * 9/2004 Himes ..... 422/5
2005/0022417 A1 2/2005 DuRapau
2005/0205499 A1 9/2005 Botner
2011/0000098 A1 * 1/2011 Karafinka ..... 34/202
2012/0151789 A1 * 6/2012 Hurst ..... 34/202

FOREIGN PATENT DOCUMENTS

JP 09276057 A * 10/1997 ..... A47B 61/04
WO WO 9624019 A1 * 8/1996 ..... F26B 25/00

* cited by examiner

*Primary Examiner* — Stephen M Gravini
(74) *Attorney, Agent, or Firm* — Daniel J. Swirsky; AlphaPatent Associates Ltd.

(57) ABSTRACT

In one aspect, the present invention is directed to a shoe drier, comprising: a structure (16) having an enclosed space into which shoes (28) are placed for drying; a heating system (detailed in FIG. 4 and the description thereof), for heating air inside said structure, thereby drying said shoes; a first rack (36), disposed inside said enclosed space, onto which said shoes are placed for drying; a mechanism for lifting said first rack as a result of opening the top of said structure, and placing down said first rack as a result of closing the top of said structure (detailed in FIG. 3 and the description thereof); thereby facilitating the use thereof for a disabled user.

10 Claims, 4 Drawing Sheets

SHOE DRYER

The current application claims the benefit of IL Patent application no. 199710, filed 6 Jul. 2009, incorporated herein by reference.

FIELD OF THE INVENTION

The present invention relates to the field of home appliances. More particularly, the invention relates to a shoe dryer.

BACKGROUND OF THE INVENTION

Shoes tend to get wet during outings on rainy or snowy days. This problem is acute particularly in countries regularly featuring rain, snow and sleet, ski sites, and so on. Since the drying process may require several hours, sometimes even the entire day, it is desirable for more rapid drying, particularly when the user needs to go outdoors again soon.

U.S. Pat. No. 5,016,364 to Cochrane discloses a drying apparatus that utilizes air circulation to uniformly dry articles. The apparatus includes an enclosure having racks upon which the articles to be dried are placed. An air exchanger couples to the enclosure to recirculate and heat air within the enclosure. Recirculation operates continuously while articles are being dried, and recirculation air temperature is maintained around a predetermined level through a thermostat coupled to heating elements. The air exchanger is configured so that air expelled from the air exchanger travels upward near the enclosure's walls, then downward in the center of the enclosure back to the air exchanger. An exhaust fan is controlled by a humidistat to remove humid air from the enclosure whenever the humidity within the enclosure exceeds a predetermined level. Consequently, a mean humidity level is maintained within the enclosure to prevent excessive drying, and substantial recirculation of air results in improved efficiency.

One drawback of the disclosure of Cochrane is that the entire enclosure is heated, which results in energy waste if the enclosure is not fully occupied.

It is an object of the present invention to provide a shoe dryer which overcomes the above-mentioned and other problems of the prior art.

It is a further object of the present invention to provide a comprehensive solution to shoe drying.

Other objects and advantages of the invention will become apparent as the description proceeds.

SUMMARY OF THE INVENTION

In one aspect, the present invention is directed to a shoe drier, comprising:

- a structure (16) having an enclosed space into which shoes (28) are placed for drying;
  - a heating system (detailed in FIG. 4 and the description thereof), for heating air inside said structure, thereby drying said shoes;
  - a first rack (36), disposed inside said enclosed space, onto which said shoes are placed for drying;
  - a mechanism for lifting said first rack as a result of opening the top of said structure, and placing down said first rack as a result of closing the top of said structure (detailed in FIG. 3 and the description thereof);

thereby facilitating the use thereof for a disabled user.

The heating system may comprise a heating body, for heating air.

The shoe drier may further comprise a conveying system, for conveying heated air from said heating system into the interior side of said shoes.

The conveying system may comprise a propeller, for propelling air through the heating system, through a flexible pipe (30), into the interior side of the shoes (28).

According to one embodiment of the invention, the walls of the structure comprise an inlet (22) through which air enters into the enclosed space, and an outlet (18) through which air exits the enclosed space. In this way, the air inside the enclosed space retains its dryness.

The shoe drier may further comprise a first rack (36), onto which shoes to be dried are placed.

According to a preferred embodiment of the invention, the first rack (36) is a grid, thereby allowing mud and dust to fall down.

The shoe drier may further comprise a second rack (20), for collecting mud and dust that falls from drying shoes.

The shoe drier may further comprise a mechanism for lifting the first rack (36) upon opening the top (i.e., seat 14) of the structure (16), and placing down the first rack upon closing the top (i.e., seat 14) of the structure (16).

The shoe drier may further comprise an attaching mechanism, for attaching the end of a pipe (30) that conveys heated air, to the first rack (36), thereby keeping the end of a pipe (30) directed to the interior side of the shoe while the first rack moves. Such a mechanism may be a clip, a clamp, a hook, and so on.

According to one embodiment of the invention, the structure is adapted to be used as a seat (14) for a user while taking his shoes off and putting his shoes on.

The foregoing embodiments of the invention are described and illustrated in conjunction with systems and methods thereof, which are meant to be merely illustrative, and not limiting.

BRIEF DESCRIPTION OF THE DRAWINGS

Embodiments and features of the present invention are described herein in conjunction with the following drawings.

It should be understood that the drawings are not necessarily drawn to scale.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, circuits, and so on, are not described in detail.

Figure 1:
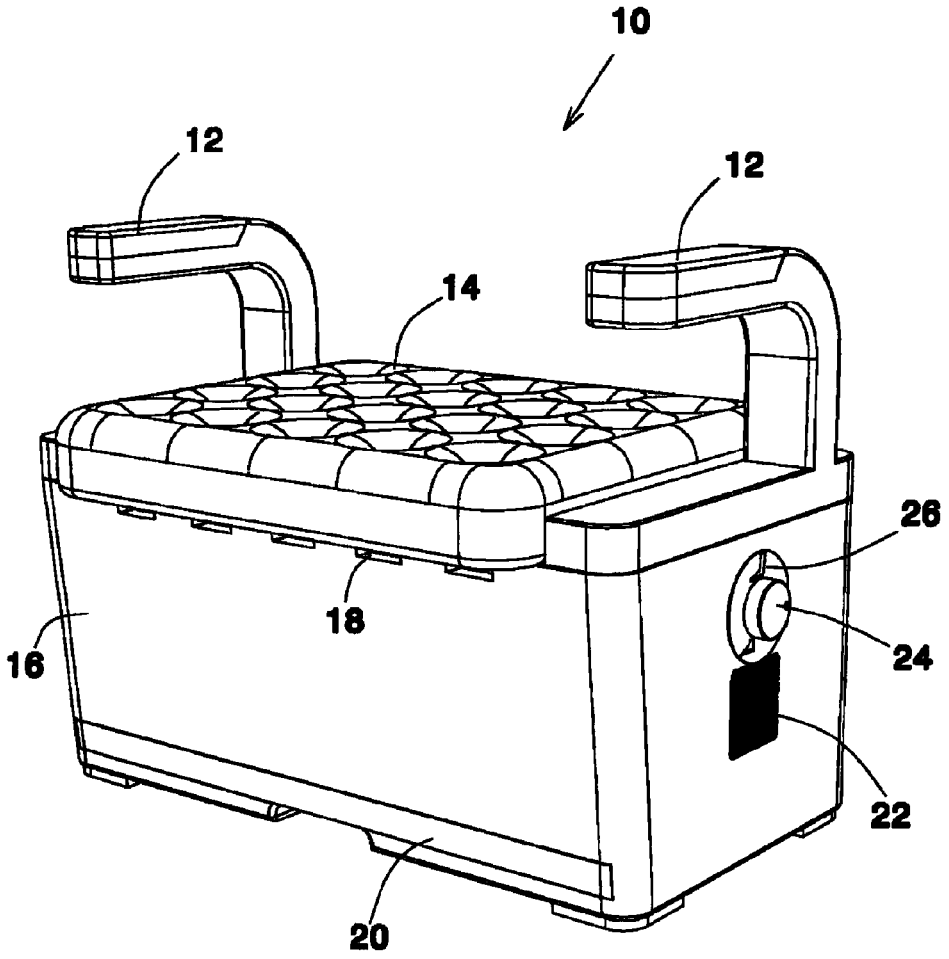
FIG. 1 is a perspective view that schematically illustrates a shoe dryer, according to one embodiment of the invention.

FIG. 1 is a perspective view that schematically illustrates a shoe dryer, according to one embodiment of the invention.

The shoe dryer, which is marked herein as reference numeral 10, is designed in the form of a chair/stool, thereby allowing a user to sit thereon when taking his shoes off or putting his shoes on.

The seat of the chair, which is marked by reference numeral 14, may be filled with padding, thereby allowing comfortable seating thereon.

The shoe dryer may further comprise arms 12, a back support, and so on, in order to enhance seat comfort. Actually, a user may sit on the chair while drying his shoes.

In the embodiment illustrated herein, the enclosure is a structure in the form of a closed box 16 having an inlet 22 and outlets 18.

A user may adjust the drying time by knob 24, and the scale thereof, 26.

Reference numeral 20 is a rack installed at the bottom of box 16, for collecting mud from drying shoes. Preferably, rack 20 is pullable.

Figure 2:
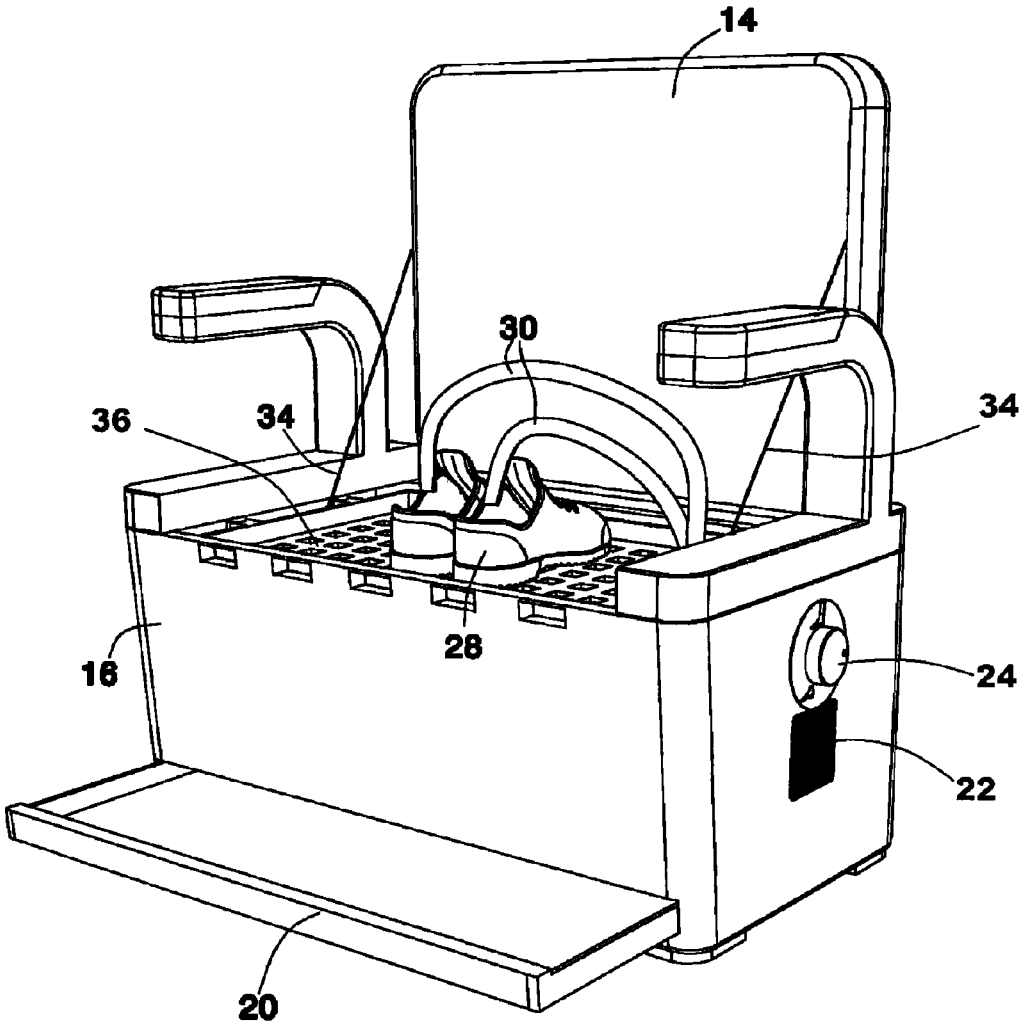
FIG. 2 is a perspective view that schematically illustrates the shoe dryer of FIG. 1 in a situation wherein the seat thereof is lifted up.

FIG. 2 is a perspective view that schematically illustrates the shoe dryer of FIG. 1 in a situation wherein the seat thereof is lifted up.

Figure 3:
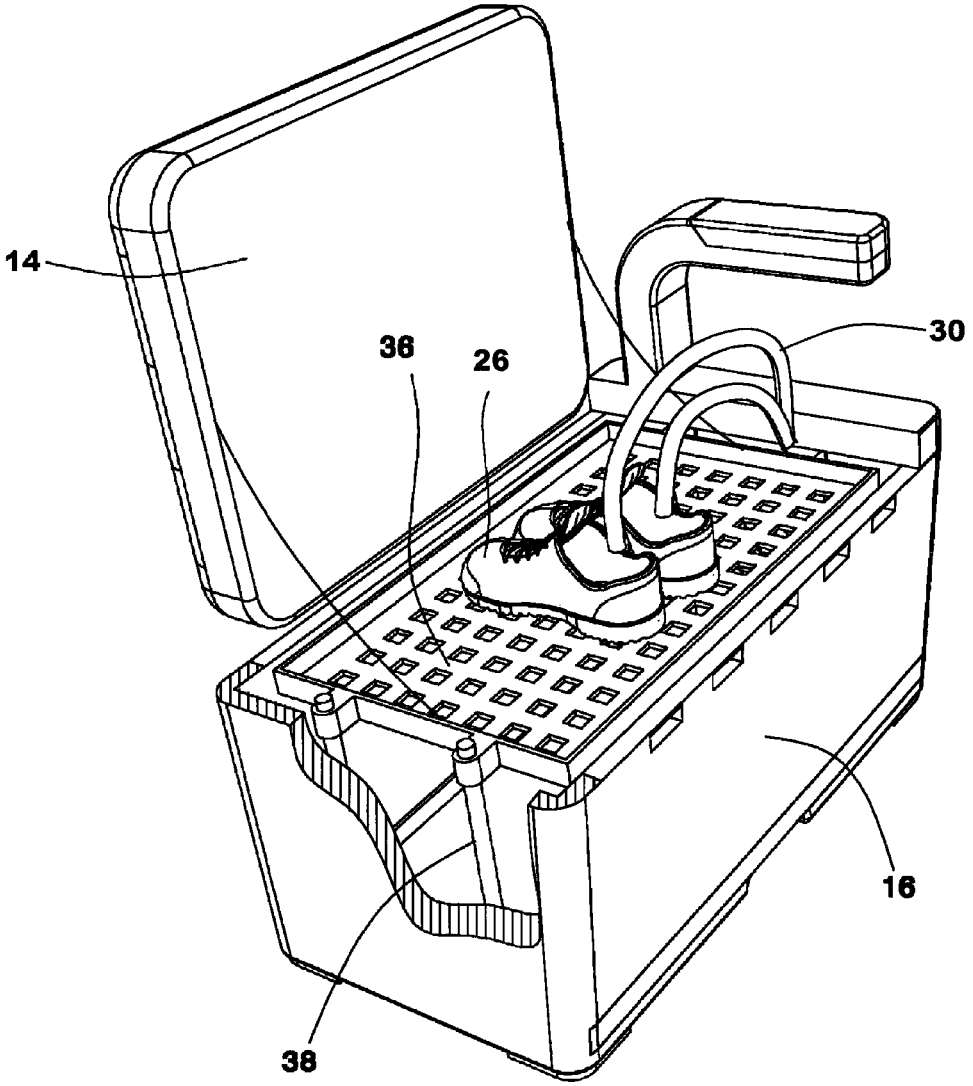
FIG. 3 is a broken view of FIG. 2, which further details the inner parts of the dryer.

FIG. 3 is a broken view of FIG. 2, which further details the inner parts of the dryer.

The top of the box (i.e., seat 14) is connected at one edge thereof, by an axle (not illustrated), to the upper back edge of box 16 of the dryer. Thus, seat 14 is also used as a cover to box 16.

A pair of strings 34 connect seat 14 to a grid 36, on which drying shoes are placed. Grid 36 is movable up and down along vertical rails 38. Upon lifting seat 14, i.e., upon opening cover 14, strings 34, which connect seat 14 to a grid 36, pull the grid upwards. Upon placing seat 14 back, i.e., upon closing cover 14, the gravity pulls grid 36 down into box 16. This mechanism facilitates the use of the shoe dryer for a disabled user.

The drying process includes conveying heated air through pipes 30, into shoes 28.

Figure 4:
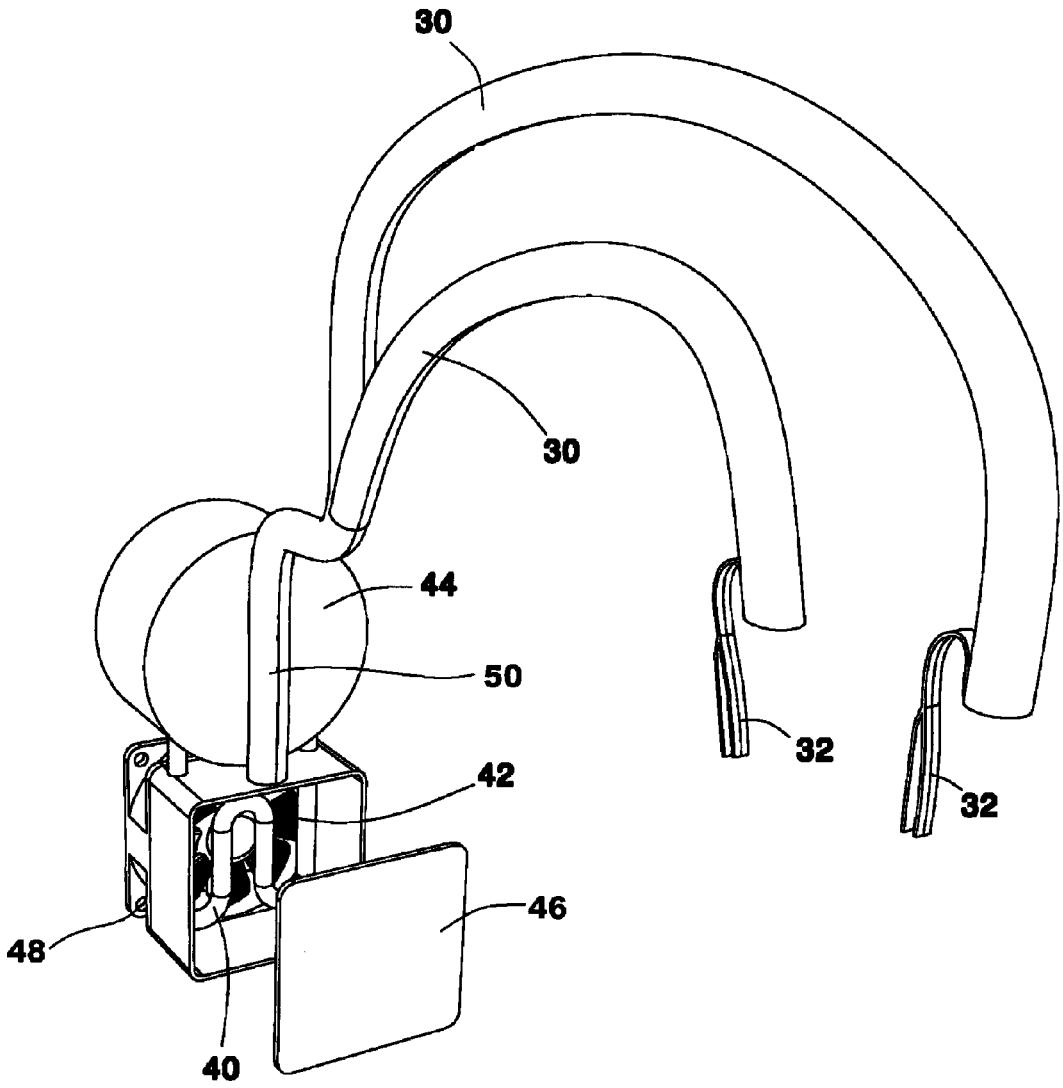
FIG. 4 schematically illustrates a drying mechanism of a shoe dryer, according to one embodiment of the invention.

FIG. 4 schematically illustrates a drying mechanism of a shoe dryer, according to one embodiment of the invention.

The drying mechanism comprises three systems:

a heating system that heats air;

a conveying system that conveys the heated air into the interior side of the shoes to be dried; and a control system that controls the time period of the heating process.

The mechanism operates as follows:

A propeller 42 propels air from outside of box 16, through heating body 40, into pipe 50, which splits into flexible pipes 30. The end of each pipe 30 is directed into the interior side of the shoes 28 to be dried. This can be carried out by attaching a clamp 32 to the end of a pipe 30. The clamp allows placing the end of pipe 30 such that heated air passing out of this end is directed into the interior side of a shoe.

Control system 44 controls the heating process. The duration of the heating process is determined by a timer, the knob of which is marked herein by reference numeral 24. The heated air directed into the shoes spreads out of the shoes, heating the entire enclosure of the box, thereby allowing drying of other wet wear, such as gloves.

According to this embodiment of the invention, the heating system is connected by bolts (not illustrated) through bores 48 to the walls of box 16. At the end of each of pipes 30 is installed a clamp 32 (clip, hook, and the like), which connects the end of pipe 30 to grid 36. In addition, pipes 30 are flexible. This allows moving grid 36 up and down, while the end of pipe 30 is connected to the grid, thereby continuing the drying process of the shoe thereof.

As illustrated, pipe 50 splits into a pair of pipes 30. However, it should be noted that the pair of pipes 30 is merely an example, and pipe 50 may split into other number of pipes, such as three pairs.

Of course, the illustrations and description herein present an example of a design, and those skilled in the art will appreciate that other designs may be used for achieving the same objects.

In the figures and/or description herein, the following reference numerals have been mentioned:

numeral 10 denotes a shoe dryer, according to one embodiment of the invention;

numeral 12 denotes arms of a chair;

numeral 14 denotes a seat, which in the example herein is used also as a cover to box 16;

numeral 16 denotes a structure, which in the example herein is a box;

numeral 18 denotes an outlet through which air exits from the enclosure of box 16;

numeral 20 denotes a rack installed at the bottom of box 16, for collecting mud from drying shoes;

numeral 22 denotes an inlet through which air is propelled into the enclosure of box 16;

numeral 24 denotes a knob for setting a timer;

numeral 26 denotes a timer scale;

numeral 28 denotes drying shoes;

numeral 30 denotes pipes that convey heated air into drying shoes;

numeral 32 denotes a clip, clamp, hook, and the like, for attaching the end of a pipe 30 to grid 36;

numeral 34 denotes a string that connects seat 14 to grid 36;

numeral 36 denotes a rack in the form of a grid, on which shoes to be dried are placed;

numeral 38 denotes a rail along which grid 36 is movable;

numeral 40 denotes a heating body;

numeral 42 denotes a propeller;

numeral 44 denotes a control system, which controls the power supply to propeller 42 and heating body 40;

numeral 46 denotes a cover of the heating system illustrated in FIG. 4;

numeral 48 denotes a bore through which a bolt (not illustrated) connects the heating system illustrated in FIG. 4 to box 16;

numeral 50 denotes a pipe into which heated air is propelled.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

What is claimed is:

1. A shoe drier, comprising:

a structure having an enclosed space into which shoes are placed for drying;

a heating system, for heating air inside said structure, thereby drying said shoes;

a first rack, onto which said shoes are placed for drying;

a mechanism for lifting said first rack as a result of opening the top of said structure for disposing said first rack horizontally outside said enclosed space, and for lowering said first rack as a result of closing the top of said structure, for disposing said first rack inside said enclosed space; thereby facilitating the use thereof for a disabled user.

2. A shoe drier according to claim 1, wherein said heating system comprises a heating body, for heating air.

3. A shoe drier according to claim 1, further comprising a conveying system, for conveying heated air from said heating system into the interior side of said shoes.

4. A shoe drier according to claim 3, wherein said conveying system comprises a propeller, for propelling air through said heating system, through a flexible pipe, into the interior side of said shoes.

5. A shoe drier according to claim 1, wherein the walls of said structure have an inlet through which air enters into said enclosed space, and an outlet through which air exits said enclosed space, thereby retaining dry air inside said enclosed space.

6. A shoe drier according to claim 1, wherein said first rack is a grid, thereby allowing mud and dust to fall down.

7. A shoe drier according to claim 1, further comprising a second rack, for collecting mud and dust that falls from drying shoes.

8. A shoe drier according to claim 3, wherein said conveying system further comprising an attaching mechanism, for attaching the end of a pipe that conveys heated air, to said first rack, thereby keeping said end of a pipe directed to the interior side of said shoe while said first rack moves.

9. A shoe drier according to claim 8, wherein said attaching mechanism is selected from a group comprising: a clip, a clamp, and a hook.

10. A shoe drier according to claim 1, wherein said structure being adapted to be used as a seat for a user while taking his shoes off and putting his shoes on.

* * * * *